United States Patent [19]

Barda, Jr.

[11] Patent Number: 4,585,093

[45] Date of Patent: Apr. 29, 1986

[54] UPRIGHT FOR LIFT TRUCK

[75] Inventor: Rudolph C. Barda, Jr., Battle Creek, Mich.

[73] Assignee: Clark Equipment Company, Buchanan, Mich.

[21] Appl. No.: 611,761

[22] Filed: May 18, 1984

[51] Int. Cl.[4] ..... B66B 9/20; F01L 15/00; F01B 1/02

[52] U.S. Cl. ..... 187/9 E; 91/189 R; 92/61

[58] Field of Search ..... 187/9 E, 9 R; 91/189 R, 91/183, 517, 533; 92/61, 76, 138

[56] References Cited

U.S. PATENT DOCUMENTS

| | | | |
|---|---|---|---|
| 2,883,003 | 4/1959 | Arnot | 187/9 E |
| 4,355,703 | 10/1982 | Bartow | 187/9 E |
| 4,356,891 | 11/1982 | Bartow | 187/9 E |
| 4,356,893 | 11/1982 | Johannson | 187/9 E |
| 4,374,550 | 2/1983 | Bartow | 187/9 E |
| 4,421,208 | 12/1983 | Robinson, Jr. | 187/9 E |
| 4,432,438 | 2/1984 | Robinson, Jr. | 187/9 E |
| 4,449,614 | 5/1984 | Matsuda | 187/9 R |
| 4,506,764 | 3/1985 | Griesenbrook et al. | 187/9 E |

FOREIGN PATENT DOCUMENTS

| | | | |
|---|---|---|---|
| 2091210 | 7/1982 | United Kingdom | 187/9 E |

*Primary Examiner*—Charles A. Marmor
*Assistant Examiner*—Gregory L. Huson
*Attorney, Agent, or Firm*—John C. Wiessler

[57] ABSTRACT

A lift truck upright having a fixed upright section, a telescopic upright section, and a load carrier mounted on the telescopic section. A pair of main lift cylinder assemblies are located adjacent opposite sides of the upright, and a second pair of relatively short free-lift cylinder assemblies are located inwardly adjacent the main lift cylinders, the pairs of lift cylinders are mounted from the fixed upright section and are hydraulically connected in parallel, and of such relative size that the free-lift cylinders and main cylinders always actuate in the proper sequence to first elevate the load carrier in free-lift and then the load carrier with the telescopic section. Maximum fork height is attained following travel of the load carrier until it contacts stops at the top of the telescopic section, whereupon continued pressure supplied to the pairs of cylinders causes extension of the free-lift cylinders to transfer hydraulic fluid to the main cylinders to aid further extension of the telescopic section until the main cylinders have traveled full stroke. The upright is designed such that the free-lift cylinders are readily interchangeable with fixed anchor rods for applications in uprights in which the free-lift feature is not required. These cylinders and the associated hydraulic components can be readily provided as a kit for interchangeability in the field. A high visibility upright is thus provided in a design which provides substantial free-lift and which is readily interchangeable with an upright having little or no free-lift.

9 Claims, 6 Drawing Figures

UPRIGHT FOR LIFT TRUCK

BACKGROUND OF THE INVENTION

The basic upright structure is a two-stage upright having a pair of main lift cylinders located adjacent opposite sides of the upright as is well known. Heretofore various means have been devised for improving operator visibility through telescopic uprights in lift trucks, including upright structures such as are disclosed in U.S. Pat. Nos. 4,355,703, 4,356,891, 4,374,550, 4,421,208, 4,432,438 and the references cited therein.

SUMMARY

My invention provides in a two-stage high visibility upright a movable, or interchangeably immovable, pair of main cable or chain anchors in the form of a pair of relatively short hydraulic cylinders located adjacent opposite sides of the upright and supported from a fixed upright section whereby to provide in the movable anchor version substantial free-lift. The movable chain anchor cylinders are connected in parallel with a pair of relatively long main cylinders in a manner to provide predetermined sequencing of the movable elements of the upright during operation. During the last stage of elevation of a load carrier on a telescopic upright section the free-lift cylinders or movable chain anchors operate with the main cylinders to further elevate the telescopic section and the load carrier thereon to maximum height.

It is an important object of the invention to provide improved operator visibility in two-stage uprights having substantial free-lift.

It is another object of the invention to provide for interchangeability between an upright having substantial free-lift and an upright having little or no free-lift with a minimum exchange of parts as between the two upright types.

Other objects, features and advantages of the invention will readily occur to persons skilled in the art from the detailed description of the invention which follows.

DETAILED DESCRIPTION

Figure 1:
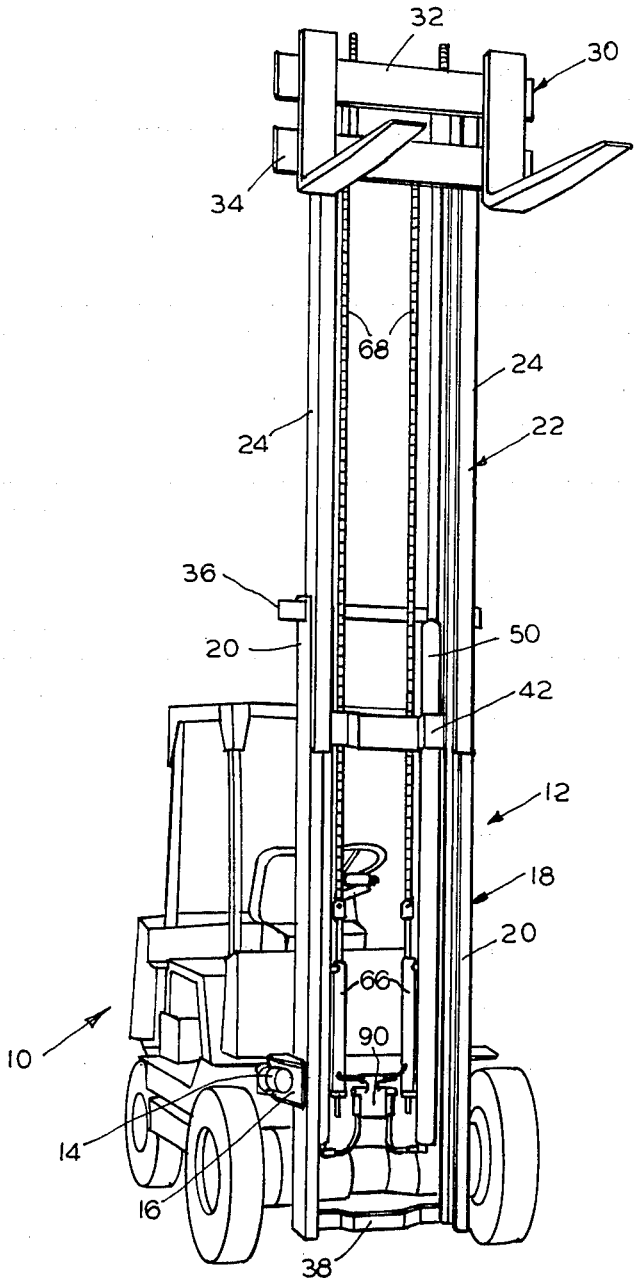
FIG. 1 is a front perspective view of an upright having mounted therein free-lift cylinders, the upright being shown mounted on a lift truck and in a position of maximum elevation.

Referring to the drawing, a lift truck of known design is shown at numeral 10. Mounted at the front end thereof in known manner is a two-stage upright 12 which is connected for forward and rearward tilting movement relative to the lift truck by a pair of tilt cylinders 14, one of which is shown, connected to upright brackets 16. A fixed mast section 18 includes a pair of transversely spaced opposed channel members 20 arranged to receive a single telescopic mast section 22 formed of two laterally spaced I-beams 24, mast section 22 being supported in mast section 18 in known manner by support guide rollers, not shown, and arranged for longitudinal movement relative thereto. A load or fork carrier 30 having a pair of transverse support plates 32 and 34 is guide roller mounted in known manner for elevation in the telescopic section. Mast section 18 is cross-braced for rigidity by means of upper, intermediate and lower tie bars 36, 38 and 39, and telescopic section 22 is cross-braced by upper and lower transverse members 40 and 42.

The I-beam mast section 22 is nested within the outer channeled section 18 in known manner such that the forward flanges of the I-beams 24 are disposed outside of and overlapping the forward flanges of channels 18 and the rear flanges of the I-beam are disposed inside the adjacent channel portions and forwardly of the rear flanges of channels 18. Additional particulars of the nested off-set I-beam upright structure, the mounting of the load carriage thereon, and the details of structure and mounting of guide and support roller pairs are explained in detail in U.S. Pat. No. 3,213,967. The upright structure as shown herein is somewhat schematized. Load carrier 30 is supported in the inner channels of I-beams 24 for elevation thereon by a pair of laterally spaced, vertically and rearwardly extending load carrier bars 44 and three pairs of guide rollers 46, all in known manner.

As illustrated, a pair of single-acting main hydraulic lift cylinders 50 are located in the upright in laterally spaced relation to provide maximum operator visibility through the upright, being secured at the lower ends thereof to a pair of mounting blocks 52 and platform blocks 54, blocks 52 and 54 being secured, as by welding, to each other and along the outer edges thereof to the inner rear flange edges of channels 24. Cylinders 50 are thereby supported from outer channels 24. The upper ends of cylinders 50 are secured by a pair of studs 56 to transverse brace member 40 of the telescopic upright section and, in the embodiment of FIGS. 1–6, preferably have a pair of spacer blocks 58 located between the top of the cylinders and the lower surface of brace 40 for a purpose to be described. Brace member 40, as best seen in FIG. 4, is secured at its outer ends to the rear flanges of the I-beams and extends rearwardly over the cylinders 50; it provides a pair of laterally spaced forward projections 60 which overlap a pair of rearward projections 62 on load carrier brackets 44, whereby to provide stops which establish the maximum elevation to which the load carrier can be actuated in upright section 22.

Figure 4:
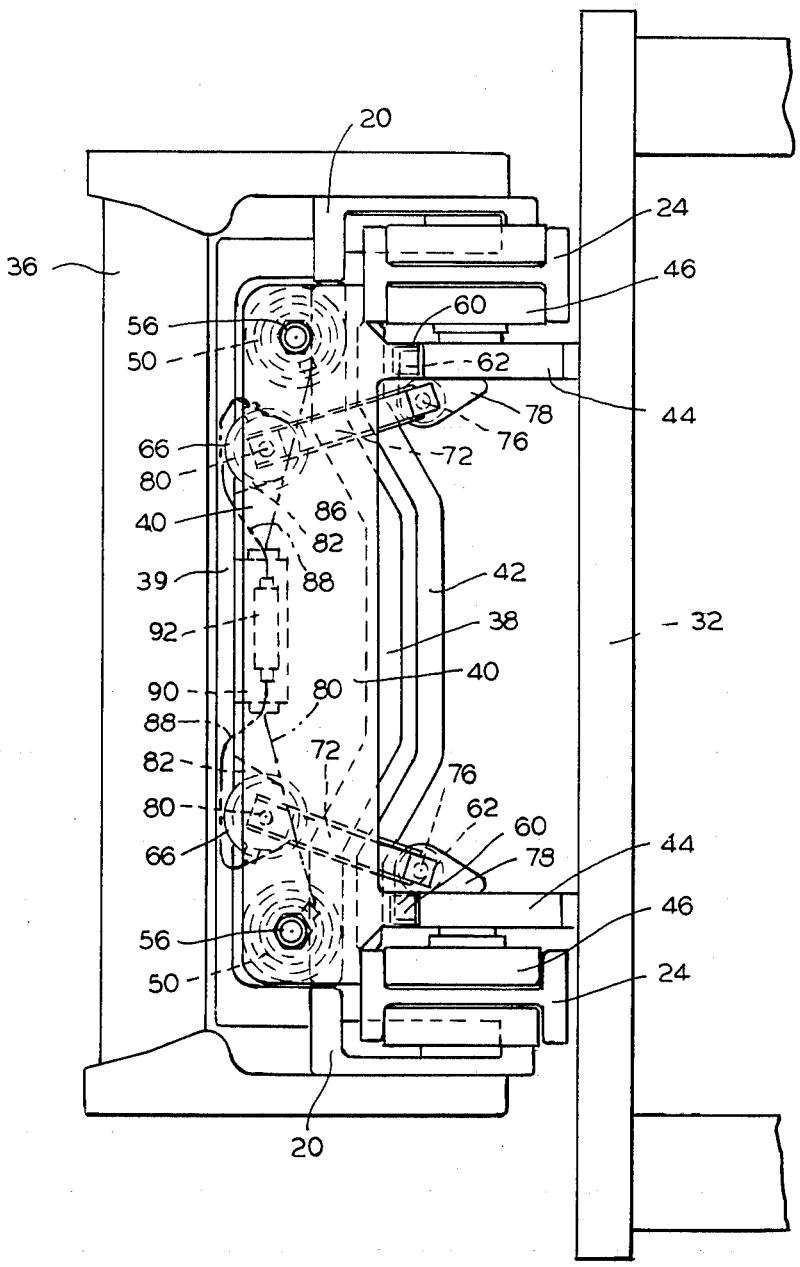
FIG. 4 is an enlarged plan view of the upright shown in FIG. 2.

As can be best observed in FIG. 4, cylinders 50 are located partially behind the rear flanges of I-beam 24 and partially rearwardly of the rear flanges of channel beams 20 to provide both maximum lateral spacing thereof to maximize operator visibility through the upright and to aid in locating the center of gravity of the upright assembly rearwardly toward the lift truck so as to minimize the distance to the load center on the load carrier in relation to the lift truck, thereby minimizng the load tipping moment on the lift truck, as is known.

A pair of laterally spaced free-lift cylinders 66 of relatively short length and having an effective lifting area of somewhat greater than one-half the diameter of cylinders 50 are spaced inwardly and somewhat rearwardly of cylinders 50 and are located low in the upright so as to minimize interference with operator visibility through the upright and to enable the operator to be able to observe the location of the forward tips of the load carrier fork tines at all times. The free-lift cylinders function as actuable anchor members for a pair of lift chains 68 which are secured at their one ends to brackets 70 on the ends of the piston rods, from which the chains extend over a pair of laterally spaced angularly supported sheaves or sprockets 72 supported for rotation in brackets 74 which depend downwardly from and are secured to brace member 40, from whence the chains extend downwardly to securement on anchor members 76 and a pair of anchor brackets 78 which are secured to the lower ends of the inner sides of support bars 44. The bottom ends of cylinders 66 are secured to tie bar 38 by a pair of anchor members 80 which are secured to plates 82 welded to tie bar 38 and extending forwardly thereof for connection with anchor members 80.

The hydraulic system of the lift truck, not shown, is connected to the pairs of cylinders 50 and 66 such that all four cylinders are connected in parallel by means of pairs of flexible conduits 86 and 88, conduits 86 connecting pressure fluid from a fluid conduit divider block 90 to inlet ports at the bottom ends of cylinders 50, and conduits 88 connecting pressure fluid from a T-connection 92 secured to divider block 90 to ports at the upper ends of cylinder 66, pressure fluid inlet to divider block 90 being shown at 94. Divider block 90 is secured to brace member 39 by studs 91. Vent lines 98 connect the bottom ends of cylinders 66 to the sump.

Figure 2:
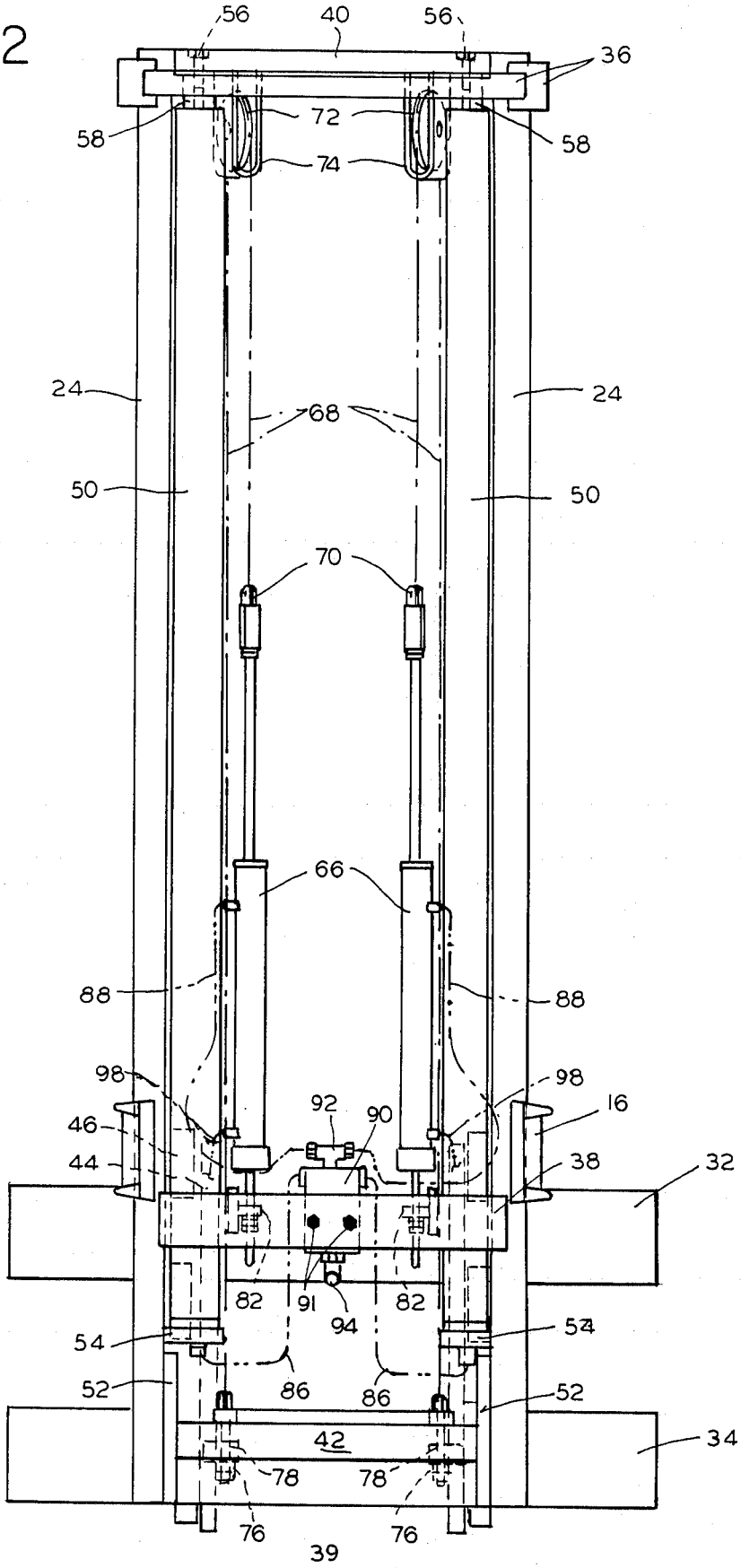
FIG. 2 is a view in rear elevation of the upright shown in FIG. 1, but in a fully collapsed condition.
Figure 3:
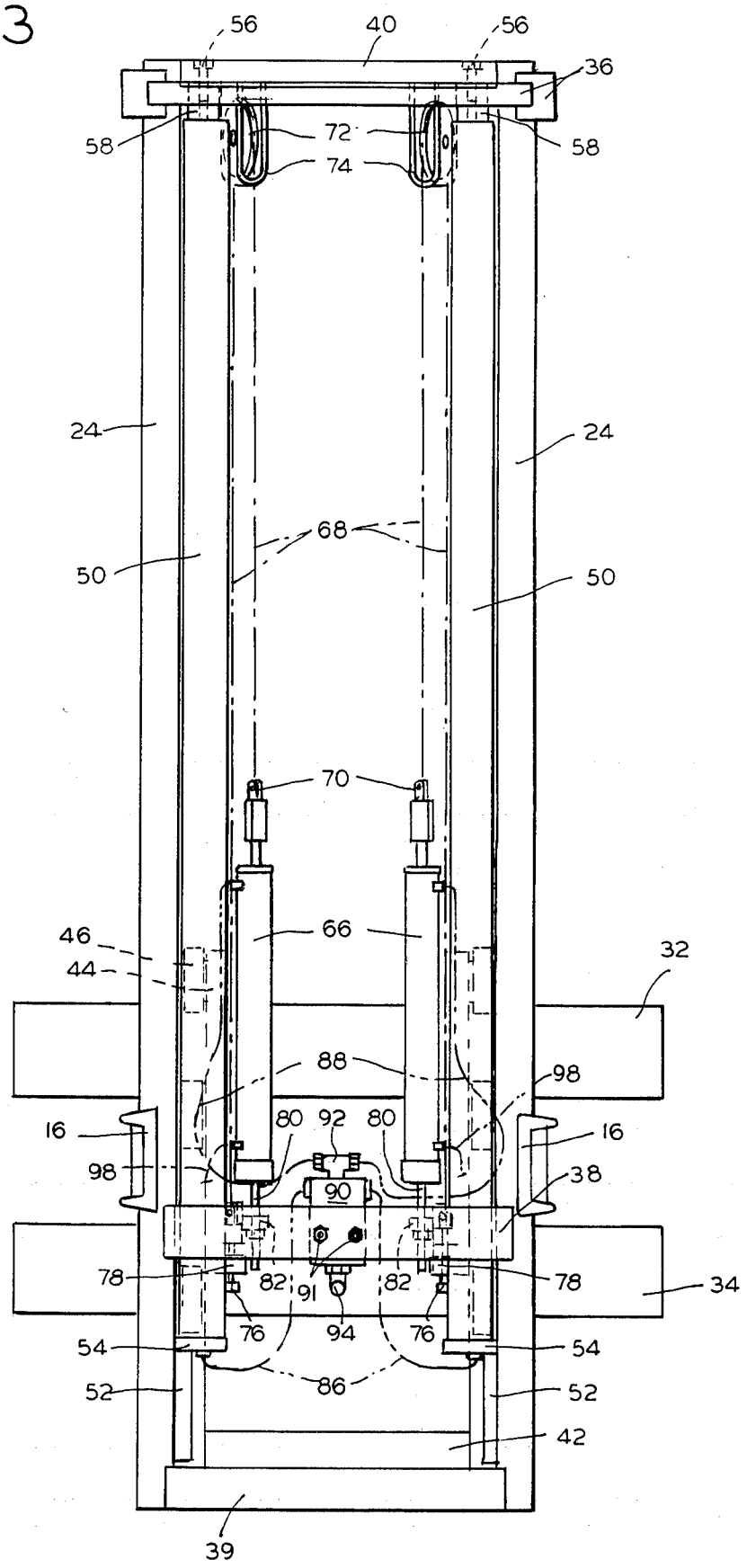
FIG. 3 shows the upright the same as in FIG. 2 except that the load carrier is shown actuated to a free-lift position.

In operation, pressure fluid is directed through inlet port 94 to the pairs of parallel connected cylinders 50 and 66 with the upright assembly in a fully collapsed condition as shown in FIG. 2, whereupon cylinders 66 are actuated first in unison to retract fully from the FIG. 2 to the FIG. 3 position thereby elevating load carrier 30 at a 1:1 ratio to its maximum free-lift position in the upright. The hydraulic fluid flowing at system pressure is then effective to elevate the pistons of cylinders 50 and sprockets 72 therewith whereby to elevate upright section 22 and the load carrier thereon at a 2:1 ratio from its position in FIG. 3 until it travels the full length of section 22 at which time projection 62 on carrier bars 44 contact stops 60 on brace 40.

Figure 5:
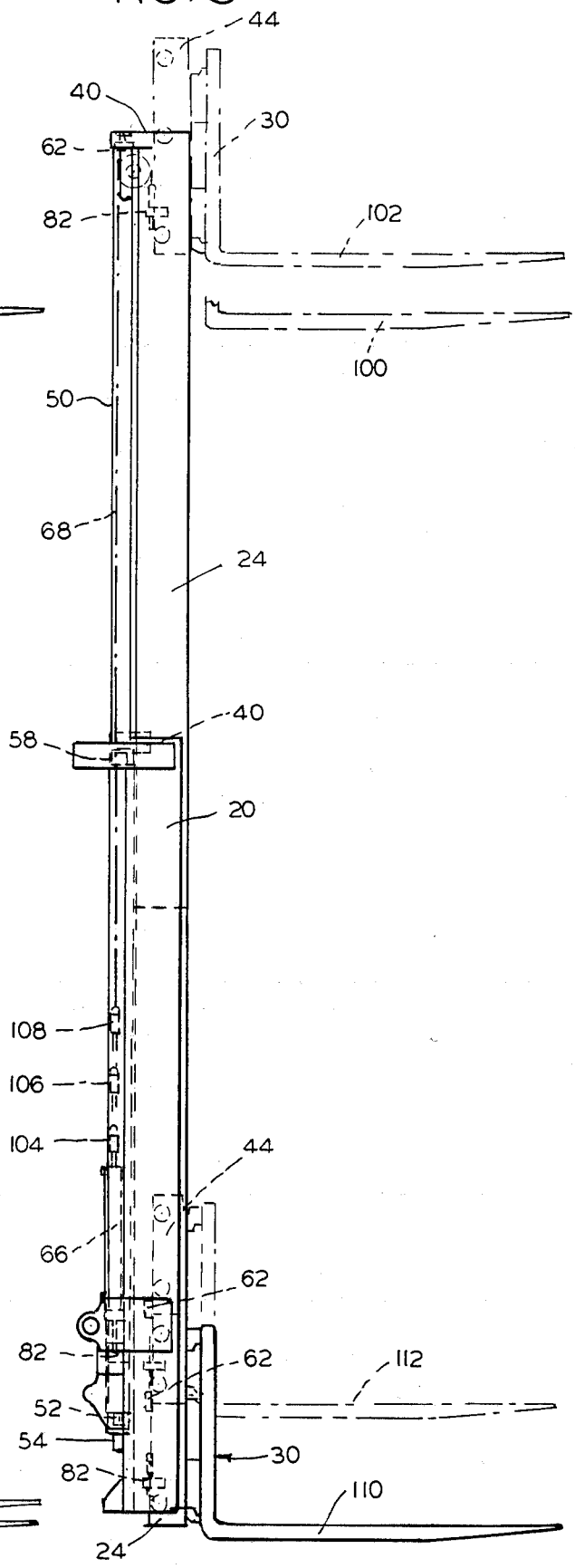
FIG. 5 is a side view elevation of the upright with the load carrier located in various stages of elevation thereon.

At this elevation the load carrier 30 has traveled partially out of the upright section, as shown at the upper end of FIG. 5, but the cylinders 50 have extended somewhat less than full stroke. The continued application of fluid pressure through divider block 90 effects a further extension to full stroke of cylinders 50 with load carrier 30 and the upright section elevating at the same speed inasmuch as these elements now comprise a locked-up unit with stop members 60,62 in abutment; chains 68 are then fully extended as shown in phantom in FIG. 5. During this final stage of lift to maximum fork height the load carrier moves from position 100 to position 102 as shown in FIG. 5 at a lifting ratio of 1:1 and the speed of elevation exceeds that which would be effected by cylinders 50 alone inasmuch as such elevation actuates the pistons of cylinders 66 from retracted positions 104 to intermediate positions of extension at 106 as a result of the lifting action of cylinders 50 whereby cylinders 66 function as pumps during this limited additional elevation adding a volume of fluid in the free-lift cylinders to the fluid volume normally flowing to cylinders 50. The position of the piston rod shown in 108 at FIG. 5 represents the position thereof with the load carrier fully down, as shown at 110, while the position of the piston rod at 104 represents load carrier free-lift position as shown at 112.

In other words, the extension of cylinders 66 as effected by cylinders 50 during the final stage of lift from position 104 to 106 represents a movable anchor which effectively adds chain length to the upright assembly thus permitting the load carrier to be further elevated with the upright section until cylinders 50 reach full stroke. Such final stage of lift is represented by the distance between piston rod positions at 104 and 106, which is also the distance between the load carrier positions at 100 and 102.

Figure 6:
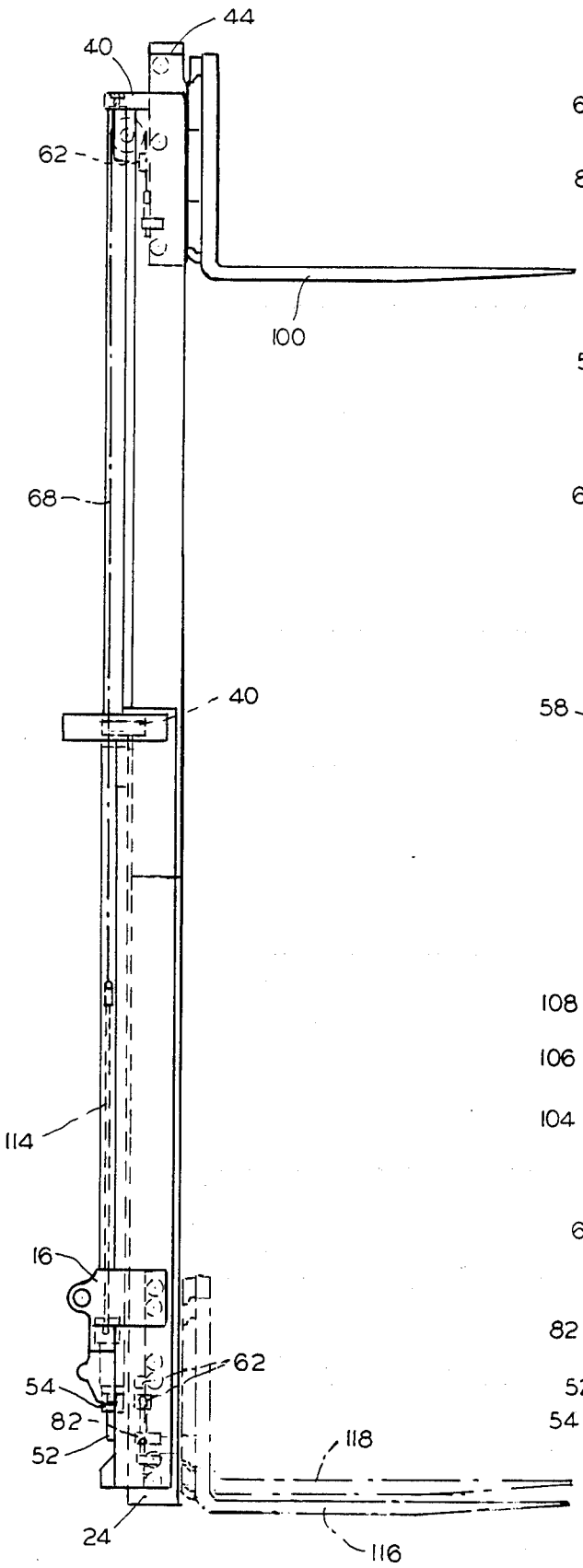
FIG. 6 shows the upright substantially as in FIG. 5 but having the movable anchors or free-lift cylinders replaced by fixed chain anchor rods.

A standard and known upright construction is represented in FIG. 6, the design and parts of which are the same as in the upright of FIGS. 1–5 except that fixed length anchor rods 114 are substituted for free-lift cylinders 66, spacer blocks 58 have been removed, and that portion of the hydraulic system which connects flow divider block 90 to the free-lift cylinders is removed. Otherwise the uprights are essentially the same and, for different applications, may be advantageously made interchangeable in the field by providing a kit for field installation which provides the above-named parts which are absent from the FIG. 6 upright for conversion to the free-lift cylinder upright as previously described. In other words, by a relatively simple field conversion kit the same basic upright may perform in different applications.

In the upright of FIG. 6 the main lift cylinders 50 operate the same as in the free-lift upright to elevate the load carrier from its lowermost position to a maximum elevated position as shown, which corresponds essentially to the position thereof in FIG. 5 at numeral 100. In this location the main cylinders 50 have extended full stroke but the load carrier has not reached full elevation in the upright section 22 and stops 60,62 are not in abutment. This is for the reason that, as distinct from the operation previously described, there is a small free-lift provided in FIG. 6 so that all vertical movement of the load carrier must be provided by operation of cylinders 50.

Spacer blocks 58 are provided in the FIG. 1–5 embodiment so as to have vertical coincidence of the outer and inner upright sections 18 and 22 with the load carrier in its full down position as shown in FIGS. 2 and 5.

When converting to the FIG. 6 embodiment it is preferable to remove spacer blocks 58 thereby lowering upright section 22 in section 18 such that brace member 40 lowers into abutment with the tops of cylinders 50 thereby lowering section 24 a small distance below the bottom of section 18. This provides for a small amount of free-lift as shown between the load carrier positions 116 and 118 as cylinders 50 elevate upright section 22 to a position of vertical coincidence with section 18. As is well known in the art, "free-lift" is defined as that degree of elevation of the load carrier which may be effected prior to any elevation of the telescopic upright section out of the fixed upright section. By removing spacer blocks 58 a "negative lift" condition is provided so that said small amount of free-lift can be realized before upright section 22 begins to elevate out of section 18. In the event that no free-lift is required then, of course, spacer blocks 58 may be left in place when converting from the one upright to the other.

In both upright types lowering of the load carrier is controlled by known flow-sensing hydraulic control valve means and operates in the reverse sequence of the lifting operation. A feature of my invention provides maximizing of load carrier elevation with shorter than usual lift cylinders 50 because of the free-lift travel provided which permits lift cylinders 50 to be located somewhat above the drive axle and thus reduce the load center dimension forward of the axle.

Although I have illustrated only certain embodiments of my invention, it will be understood by those skilled in the art that modifications may be made in the structure, form and relative arrangement of parts without departing from the spirit and scope of the invention. Accordingly, I intend to cover by the appended claims all such modifications which properly fall within the scope of my invention.

I claim:

1. An upright structure for lift trucks and the like comprising a relatively fixed upright section, a telescopic upright section mounted for elevation relative to the fixed section, load carrier means mounted for elevation relative to said telescopic section, a pair of transversely spaced main lift cylinders mounted adjacent opposite sides of the upright supported at the lower ends thereof from the fixed upright section and being connected at the upper ends thereof to the telescopic upright section, a pair of flexible lifting and sprocket means, the sprocket means being supported from the upper end of the telescopic upright section and the flexible lifting means being reeved thereon and secured at one ends to the load carrier means, a pair of transversly spaced free-lift hydraulic cylinders functioning as movable anchor means secured at one ends to a member fixed relative to the fixed upright section, the opposite ends thereof being movably connected to the opposite ends of said flexible lifting means, said pairs of main and free-lift cylinders being connected hydraulically in parallel by pressure fluid supply means and sequencing automatically to first elevate the load carrier in free-lift and then to elevate the telescopic upright section and the load carrier thereon, and wherein continuing the supply of pressure fluid to the pairs of cylinders subsequent to the elevation of the load carrier to its maximum elevation in the telescopic section causes the main cylinders to effect further elevation of the load carrier together with the telescopic section to full stroke positions of the main cylinders while causing the free-lift cylinder to extend from retracted positions thereby pumping a volume of hydraulic fluid from the free-lift cylinders to the main cylinders, said free-lift cylinders being replaceable by fixed anchor means and spacer means provided between the tops of the main lift cylinders and the telescopic upright member to which the main cylinders are connected to provide substantial planar coincidence of the fixed and telescopic sections at the top and bottoms thereof when the upright is fully retracted, said spacer means being removable when said fixed anchor means replaces said free-lift cylinders in order to provide a small negative lift to the telescopic section when the upright is fully retracted.

2. An upright structure as claimed in claim 1 wherein the velocity of elevation in the final stage thereof is increased by the transferal of hydraulic fluid from the free-lift to the main cylinders.

3. An upright structure as claimed in claim 1 wherein said interchangeable free-lift cylinders and fixed anchor means provide an interchangeable upright having different operational characteristics whereby two basic interchangeable upright types are made available for field conversion by exchanging the fixed anchor means for said free-lift cylinders.

4. An upright structure as claimed in claim 1 wherein the field conversion effected by exchanging said fixed anchor means for said free-lift cylinders also involves disconnecting the free-lift cylinders from the in-parallel hydraulic circuit.

5. An upright structure for lift trucks and the like comprising a relatively fixed upright section, a telescopic upright section mounted for elevation relative to the fixed section, load carrier means mounted for elevation relative to said telescopic section, a pair of transversely spaced main lift cylinders mounted adjacent opposite sides of the upright supported at the lower ends thereof from the fixed upright section and being connected at the upper ends thereof to the telescopic upright section, a pair of flexible lifting and sprocket means, the sprocket means being supported from the upper end of the telescopic upright section and the flexible lifting means being reeved thereon and secured at one ends to the load carrier means, a pair of transversely spaced movable anchor means secured to a member fixed relative to the fixed upright section and being movably connected to the opposite ends of said flexible lifting means, said movable anchor means being replaceable by fixed or immovable anchor means to provide an interchangeable upright having different operational characteristics, and spacer means provided between the tops of the main lift cylinders and the telescopic upright member to which the main cylinders are connected to provide substantial planar coincidence of the fixed and telescopic sections of the tops and bottoms thereof when the upright is fully retracted, said spacer means being removable when said fixed anchor means replaces said movable anchor means in order to provide a small negative lift of the telescopic section when the upright is fully retracted.

6. An upright structure as claimed in claim 5 wherein operation of said upright from said negative lift condition provides a relatively small free lift of said load carrier.

7. An upright structure as claimed in claim 5 wherein said pair of movable anchor means comprise a pair of transversely spaced free-lift hydraulic cylinders whereby two basic interchangeable upright types are made available for field conversion by exchanging the fixed anchor means for said free-lift cylinders.

8. An upright structure as claimed in claim 7 wherein spacer means are provided between the upper ends of said main lift cylinders and the member of the telescopic section to which the main cylinders are connected, further field conversion to provide third upright operating characteristics being available by removal of said spacer means to provide negative lift when substituting said fixed anchor means for said free-lift cylinders.

9. An upright structure as claimed in claim 7 wherein said pairs of main and free-lift cylinders are connected hydraulically in parallel and the field conversion effected by exchanging fixed anchor means for said free-lift cylinders also involves disconnecting the free-lift cylinders from the in-parallel hydraulic circuit.

* * * * *